US007637590B2

(12) United States Patent
Jeong et al.

(10) Patent No.: US 7,637,590 B2
(45) Date of Patent: Dec. 29, 2009

(54) PRINTHEAD, SCANNING TYPE INKJET IMAGE FORMING APPARATUS HAVING THE SAME, AND METHOD OF PERFORMING A PRINTING OPERATION WITH HIGH RESOLUTION

(75) Inventors: Jong-un Jeong, Suwon-si (KR); Min-ho Chun, Gwangmyeong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 621 days.

(21) Appl. No.: 11/437,821

(22) Filed: May 22, 2006

(65) Prior Publication Data

US 2006/0268061 A1 Nov. 30, 2006

(30) Foreign Application Priority Data

May 26, 2005 (KR) ..... 10-2005-0044464

(51) Int. Cl.
*B41J 2/15* (2006.01)
*B41J 2/145* (2006.01)

(52) U.S. Cl. ..... 347/40; 347/41; 347/49

(58) Field of Classification Search ..... 347/16, 347/41, 9, 12, 40, 49
See application file for complete search history.

(56) References Cited

U.S. PATENT DOCUMENTS 4,540,996 A * 9/1985 Saito ..... 347/43
4,999,646 A 3/1991 Trask
5,430,469 A * 7/1995 Shioya et al. ..... 347/15
6,299,283 B1 * 10/2001 Kakutani et al. ..... 347/41
6,302,517 B1 * 10/2001 Kanaya ..... 347/41
6,341,834 B1 * 1/2002 Yokoi ..... 347/16

FOREIGN PATENT DOCUMENTS

| | | |
|---|---|---|
| JP | 10-278317 | 10/1998 |
| JP | 2000-025207 | 1/2000 |
| JP | 2000-094717 | 4/2000 |
| KR | 1999-022291 | 3/1999 |
| KR | 2000-73165 | 12/2000 |

OTHER PUBLICATIONS

Korean Office Action dated Jul. 25, 2006 issued in KR 2005-44464.

* cited by examiner

*Primary Examiner*—Thinh H Nguyen
(74) *Attorney, Agent, or Firm*—Stanzione & Kim LLP

(57) ABSTRACT

A printhead, a scanning type inkjet image forming apparatus having the same, and a method of performing a printing operation with a high resolution. Separate N nozzle units are disposed in the printhead such that images can be printed with higher resolution. In addition, the printing operation can be performed with an actual resolution or a higher resolution while a print medium is fed at a uniform speed such that the printing speed can be increased when the printing operation is performed with the higher resolution. In addition, when a portion of nozzles of a first nozzle unit is damaged or is malfunctioning, the portion of the nozzles is compensated for using a second nozzle unit such that an image quality is not affected by a defective nozzle.

15 Claims, 12 Drawing Sheets

PRINTHEAD, SCANNING TYPE INKJET IMAGE FORMING APPARATUS HAVING THE SAME, AND METHOD OF PERFORMING A PRINTING OPERATION WITH HIGH RESOLUTION

CROSS-REFERENCE TO RELATED APPLICATIONS

This application claims the benefit of Korean Patent Application No. 2005-44464, filed on May 26, 2005, in the Korean Intellectual Property Office, the disclosure of which is incorporated herein in its entirety by reference.

BACKGROUND OF THE INVENTION

1. Field of the Invention

The present general inventive concept relates to an inkjet image forming apparatus, and more particularly, to a scanning type inkjet image forming apparatus which performs a printing operation with high resolution.

2. Description of the Related Art

Scanning type inkjet image forming apparatuses eject ink from a printhead that is reciprocated in a direction that is perpendicular to a feeding direction of a print medium while being spaced apart from a top side of the print medium by a predetermined gap, thereby forming an image. Printing quality is a very important factor in inkjet image forming apparatuses. Thus, the scanning type inkjet image forming apparatuses perform a printing operation using a shingling process, so as to improve printing quality. Here, the shingling process is a technique in which printing is repeatedly and overlappingly performed while finely moving a printing position of the printhead.

In an effort to enhance the printing quality, U.S. Pat. No. 4,999,646 describes a conventional shingling process performed by an image forming apparatus. FIG. 1 illustrates dot patterns printed with the conventional shingling process. As illustrated in FIG. 1, a predetermined portion of dot patterns is overlappingly printed using one nozzle unit during a first scanning operation and second scanning operation to enhance uniformity and consistency of dots deposited on a print medium. In this case, a feeding speed and a printing speed of the print medium are substantially reduced. In addition, when portions of nozzles are damaged or certain nozzles are malfunctioning, and a printing operation is performed in a normal mode (i.e., without using the shingling process), a portion of the print medium that corresponds to the portions of the nozzles that are damaged or the malfunctioning nozzles is not printed. As a result, printing defects such as a white line (or the like) may occur.

In the above-described conventional image forming apparatus, a high-speed printing operation cannot be performed. Thus, a scanning type inkjet image forming apparatus having an improved structure to perform high-speed printing operation is needed.

SUMMARY OF THE INVENTION

The present general inventive concept provides a scanning type inkjet image forming apparatus having a high printing resolution and a method of performing a printing operation with the high printing resolution The present general inventive concept also provides a scanning type inkjet image forming apparatus which increases a printing speed when performing a printing operation with a high resolution and a method of performing a printing operation with the high resolution.

The present general inventive concept also provides a scanning type inkjet image forming apparatus which prevents deterioration of printing quality by compensating for damaged portions of nozzles and/or malfunctioning nozzles, and a method of performing a printing operation with a high resolution.

Additional aspects of the present general inventive concept will be set forth in part in the description which follows and, in part, will be obvious from the description, or may be learned by practice of the general inventive concept.

The foregoing and/or other aspects of the present general inventive concept are achieved by providing a scanning type printhead movable along a main scanning direction, the printhead including N nozzle units having a plurality of nozzles arrayed in a subsidiary scanning direction perpendicular to the main scanning direction such that N nozzle units are adjacent to one another in a subsidiary scanning direction, and the N nozzle units being disposed such that a distance along the subsidiary scanning direction between centers of nozzles of the adjacent nozzle units is about $D \times M + D/N$ from a nozzle unit disposed at a first end of the printhead to a nozzle unit disposed at a second end of the printhead, where M is a predetermined integer and D is a nozzle pitch.

Each of the N nozzle units may be spaced apart from one another in the subsidiary scanning direction by a predetermined gap.

Each of the N nozzle units may include the same number of nozzles.

The N nozzle units may be disposed such that a distance along the main scanning direction between centers of the nozzles of the adjacent nozzle units is about $d \times L + d/N$ from the first end nozzle unit to the second end nozzle unit, where L is a predetermined integer and d is a diameter of a nozzle.

The N nozzle units may include a first nozzle unit and a second nozzle unit.

The foregoing and/or other aspects of the present general inventive concept are also achieved by providing a scanning type printhead movable along a main scanning direction, the printhead including N nozzle units having a plurality of nozzles arrayed in a subsidiary scanning direction perpendicular to the main scanning direction, and the N nozzle units being disposed such that a distance along the main scanning direction between centers of nozzles of the nozzle units that are adjacent to each other is about $d \times L + d/N$ from a nozzle unit disposed at a first end of the printhead to a nozzle unit disposed at a second end of the printhead, where L is a predetermined integer and d is a diameter of a nozzle.

The foregoing and/or other aspects of the present general inventive concept are also achieved by providing a scanning type inkjet image forming apparatus, including a printhead movable in a main scanning direction and including N nozzle units having a plurality of nozzles arrayed in a subsidiary scanning direction, a print medium-feeding unit to feed a print medium in the subsidiary scanning direction, and a controller to synchronize an ejection operation of the printhead and a feeding operation of the print medium-feeding unit such that ink ejected from the printhead is deposited at a desired position of the print medium, wherein the N nozzle units are disposed such that a distance along the subsidiary direction between centers of nozzles of the nozzle units that are adjacent to each other is about $D \times M + D/N$ from a nozzle unit disposed at a first end of the printhead to a nozzle unit disposed at a second end of the printhead, where M is a predetermined integer and D is a nozzle pitch.

The N nozzle units may include a first nozzle unit and a second nozzle unit.

The scanning type inkjet image forming apparatus may further include a printing environment information unit to store information about a printing resolution when a printing operation is performed with a predetermined resolution, and the controller operates the first and second nozzle units according to the printing resolution stored in the printing environment information unit.

The controller may perform a first scanning operation including a printing operation using the first nozzle unit with an actual resolution and feed the print medium by a width of the first nozzle unit before performing a second scanning operation including another printing operation using the first nozzle unit.

The controller may perform a first scanning operation including a printing operation using the first nozzle unit and the second nozzle unit with a higher resolution and feed the print medium by a width of the first nozzle unit before performing a second scanning operation including another printing operation using the first nozzle unit and the second nozzle unit.

The width of the first nozzle unit may be the same as a width of the second nozzle unit.

The foregoing and/or other aspects of the present general inventive concept are also achieved by providing a method of performing a printing operation with a high resolution in a scanning type inkjet image forming apparatus including a first nozzle unit and a second nozzle unit having a plurality of nozzles arrayed in a subsidiary scanning direction, and the first nozzle unit and the second nozzle unit are disposed such that a distance between centers of nozzles of the first and second nozzle units is $D \times M + D/2$, where M is a predetermined integer and D is a nozzle pitch, the method including receiving a resolution input from a host, comparing the input resolution with an actual resolution of a printhead including the first and second nozzle units, ejecting ink onto a print medium to print an image, determining whether a printing operation has been completely performed, and if the printing operation has not been completely performed, ejecting ink onto the print medium after the print medium is fed by a predetermined distance in the subsidiary scanning direction.

The ejecting of the ink and the determining of whether the printing operation is complete may include, if the input resolution is higher than the actual resolution of the printhead, performing the printing operation using the first nozzle unit and the second nozzle unit; and if the input resolution is the same as the actual resolution of the printhead, performing the printing operation using the first nozzle unit.

The ejecting of the ink onto the print medium after the print medium is fed by the predetermined distance in the subsidiary scanning direction may include feeding the print medium by a width of the first nozzle unit.

The width of the first nozzle unit may be the same as a width of the second nozzle unit.

The comparing of the input resolution with the actual resolution of the printhead may include sensing whether a defective nozzle exists in the first nozzle unit. Additionally, the ejecting of the ink onto the print medium may include compensating for the defective nozzle using nozzles of the second nozzle unit that correspond to the defective nozzle when the defective nozzle exists in the first nozzle unit.

The foregoing and/or other aspects of the present general inventive concept are also achieved by providing a printhead movable along a main scanning direction of an image forming apparatus, the printhead including at least one nozzle unit extending along a subsidiary direction that is perpendicular to the main scanning direction. The at least one nozzle unit includes a first sub nozzle unit disposed at a first end of the at least one nozzle unit in the subsidiary scanning direction to eject ink of a predetermined color and having a first plurality of nozzles extending along the subsidiary scanning direction from the first end of the at least one nozzle unit toward a middle of the at least one nozzle unit, and a second sub nozzle unit disposed at a second end of the at least one nozzle unit in the subsidiary scanning direction opposite to the first end to eject ink of the predetermined color and having a second plurality of nozzles extending along the subsidiary scanning direction from the second end of the nozzle unit toward the middle of the at least one nozzle unit.

The foregoing and/or other aspects of the present general inventive concept are also achieved by providing a printhead unit, including a carriage that is movable along a first direction with respect to a print medium, and a printhead supported by the carriage and having two or more nozzle units extending along a second direction perpendicular to the first direction to eject ink of the same color to the same portion of the print medium.

The foregoing and/or other aspects of the present general inventive concept are also achieved by providing a printhead unit, including a carriage movable along a main scanning direction of a print medium, and the main scanning direction is perpendicular to a subsidiary scanning direction along in which the print medium is conveyed, and a printhead having at least first and second nozzle units each having a plurality of nozzles arranged along the subsidiary scanning direction such that the first nozzle unit prints to the print medium in a first operation mode, and the first and second nozzle units print to the print medium in a second operation mode.

The foregoing and/or other aspects of the present general inventive concept are also achieved by providing an image forming apparatus, including a printhead unit having a carriage that is movable along a first direction, and a printhead supported by the carriage and having two or more nozzle units extending along a second direction that is perpendicular to the first direction to eject ink of a predetermined color that is the same to a predetermined portion of a print medium that is the same.

The foregoing and/or other aspects of the present general inventive concept are also achieved by providing an image forming apparatus, including a carriage type printhead having an actual resolution and being moveable in a first direction and having at least two nozzle units disposed adjacent to each other along a second direction perpendicular to the first direction, and a controller to receive information about a selected printing resolution, to compare the selected printing resolution with the actual resolution, to control one of the nozzle units to print when the selected printing resolution is the same as the actual resolution, and to control each of the at least two nozzle units to print when the selected printing resolution is greater than the actual resolution.

The foregoing and/or other aspects of the present general inventive concept are also achieved by providing a method of controlling a printhead unit having a carriage that is movable along a first direction with respect to a print medium and a printhead supported by the carriage and having two or more nozzle units extending along a second direction perpendicular to the first direction to eject ink of the same color to the same portion of the print medium, the method including performing a first printing operation in which a first nozzle unit prints to a first portion of the print medium, and performing a second printing operation in which the first nozzle unit prints to a second portion of the print medium while a second nozzle unit prints to the first portion of the print medium.

BRIEF DESCRIPTION OF THE DRAWINGS

These and/or other aspects of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
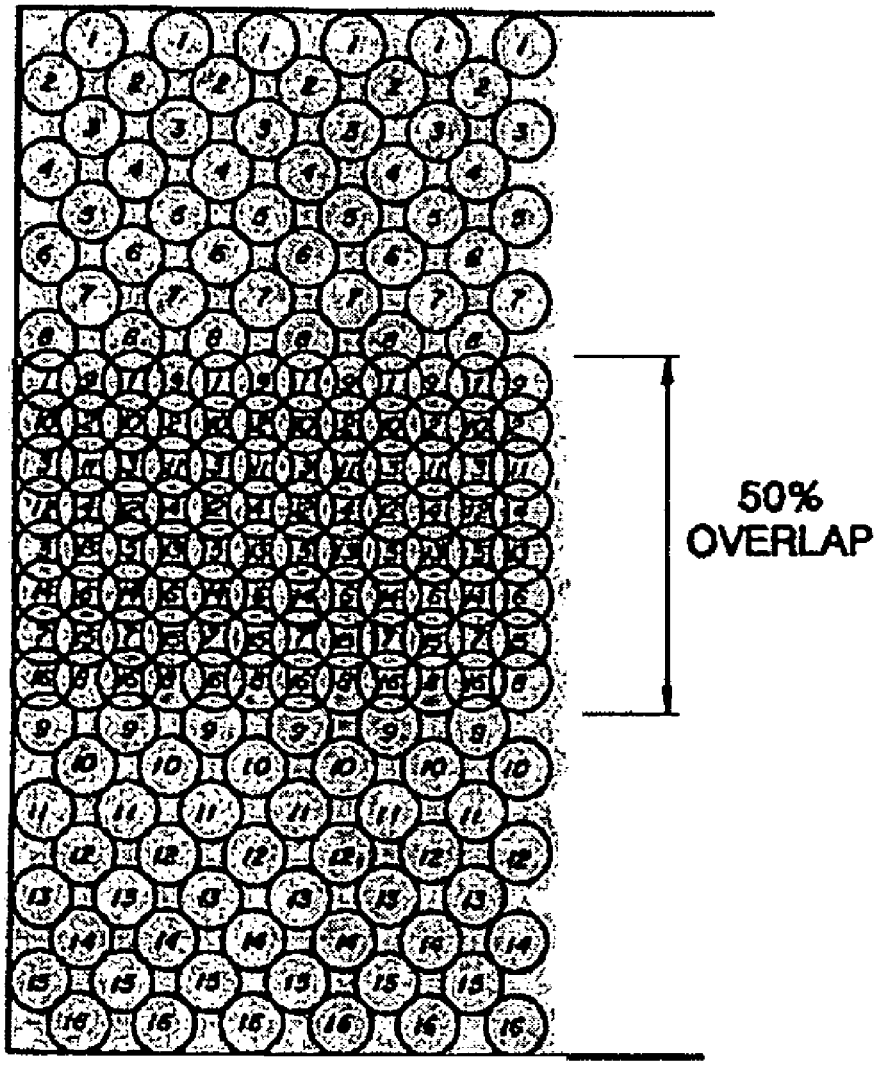
FIG. 1 (PRIOR ART)
FIG. 1 illustrates dot patterns printed with a conventional shingling method using an inkjet image forming apparatus.

A printhead, a scanning type inkjet image forming apparatus having the same, and a method of performing a printing operation with high resolution according to exemplary embodiments of the present general inventive concept will now be described with reference to the accompanying drawings. For a better understanding of the description, the entire structure of the scanning type inkjet image forming apparatus will be first described and then the method of performing a printing operation with high resolution according to the exemplary embodiments of the present general inventive concept will be described. The thicknesses of lines or the sizes of components shown in the drawings are exaggerated for a better understanding of the description.

Figure 2:
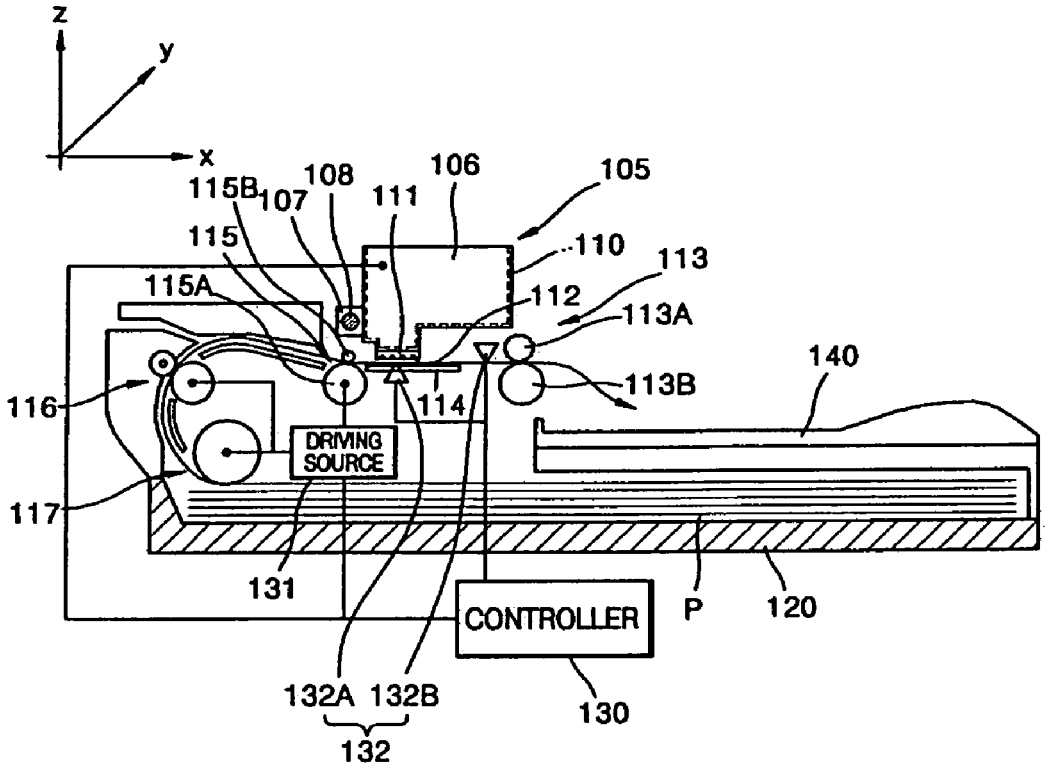
FIG. 2 is a schematic view of a scanning type inkjet image forming apparatus according to an embodiment of the present general inventive concept.

FIG. 2 is a schematic view illustrating a scanning type inkjet image forming apparatus according to an embodiment of the present general inventive concept. Referring to FIG. 2, the scanning type inkjet image forming apparatus includes a paper feeding cassette 120, a printhead unit 105, a support member 114 that faces the printhead unit 105, print medium-feeding units 113, 115, 116, and 117 that feed a print medium P in a subsidiary scanning direction, and a stacking unit 140 on which discharged print medium P is stacked. The printhead unit 105 includes a body 110, a carriage 106, a printhead 111 disposed a bottom surface of the body 110 having a nozzle unit 112.

The print medium P is stacked on the paper feeding cassette 120. The print medium P stacked on the paper feeding cassette 120 is fed to the printhead 111 by the print medium-feeding units 113, 115, 116, and 117, which will be described later. In FIG. 2, the print medium P is fed in an x-direction which is the subsidiary scanning direction, and the printhead 111 moves in a y-direction which is a main scanning direction. The subsidiary scanning direction and the main scanning direction may be perpendicular to each other. Alternatively, the subsidiary scanning direction and the main scanning direction may be inclined at a predetermined angle.

The print medium-feeding units 113, 115, 116, and 117 feed the print medium P stacked on the paper feeding cassette 120 along a predetermined path. In FIG. 2, the print medium-feeding units 113, 115, 116, and 117 include a pickup roller 117, feeding rollers 115 and 116, and a paper discharging roller 113. The print medium-feeding units 113, 115, 116, and 117 are driven by a driving source 131, such as a motor and provide a force to transfer the print medium P. The operation of the driving source 131 is controlled by a controller 130, which will be described later.

The pickup roller 117 is installed at one side of the paper feeding cassette 120 and picks up the print medium P stacked in the paper feeding cassette 120 sheet by sheet, thereby drawing the print medium P from the paper feeding cassette 120. The pickup roller 117 is rotated while pressing a top side of the print medium P, thereby feeding the print medium P out of the paper feeding cassette 120.

The feeding roller 115 is installed at an inlet side of the printhead 111 and feeds the print medium P picked up by the pickup roller 117 to the printhead 111. In this case, the feeding roller 115 can also align the print medium P so that ink can be ejected onto a desired portion of the print medium P before the print medium P passes under the printhead 111. The feeding roller 115 includes a driving roller 115A that provides a force to transfer the print medium P, and an idle roller 115B elastically engaged with the driving roller 115A. A pair of feeding rollers 116 (e.g., auxiliary rollers) that feed the print medium P can be further installed between the pickup roller 117 and the feeding roller 115.

The paper discharging roller 113 is installed at an outlet side of the printhead 111 and discharges the print medium P, on which a printing operation has been completed, out of the image forming apparatus. The print medium P discharged out of the image forming apparatus is stacked on the stacking unit 140. The paper discharging roller 113 includes a star wheel 113A installed along a widthwise direction of the print medium P, and a support roller 113B that faces the star wheel 113A and supports a rear side of the print medium P. The printhead 111 makes a reciprocating motion in the main scanning direction to eject ink on the top side of the print medium P. When the top side of the print medium P is wet by ink, the print medium P may wrinkle. If wrinkling is severe, the print medium P may contact the nozzle unit 112 or the bottom surface of the body 110, undried ink may be spread on the print medium P, and an image printed thereon may be contaminated or smeared. In addition, due to the wrinkling, there is a high probability that a distance between the print medium P and the nozzle unit 112 may not be maintained. The star wheel 113A is used to prevent the print medium P fed underneath the nozzle unit 112 from contacting the nozzle unit 112 or the bottom surface of the body 110 and to prevent the distance between the print medium P and the nozzle unit 112 from varying. At least a part of the star wheel 113A is installed to protrude further than the nozzle unit 112 and makes point contact with the top side of the print medium P. According to the above structure, the star wheel 113A makes point contact with the top side of the print medium P so that an image formed by ink that has been ejected on the top side of the print medium P and has not dried yet, is prevented from being contaminated or smeared. Alternatively, a plurality of star wheels may be installed so as to feed the print medium P smoothly. When the plurality of star wheels are installed to be parallel to the feeding direction of the print medium P, a plurality of support rollers that correspond to the star wheels may also be provided.

In addition, when printing is consecutively performed on more than one sheet of the print medium P, the print medium P is discharged and stacked on the stacking unit 140 and then, a next sheet of the print medium P is discharged before ink ejected on the top side of a current sheet of the print medium P is dried, and a rear side of the next sheet of the print medium P may be contaminated. To prevent this problem from occurring, an additional drying device (not shown) may be further provided.

The support member 114 is disposed below the printhead 111 so that a predetermined distance between the nozzle unit 112 and the print medium P is maintained, and supports the rear side of the print medium P. The predetermined distance between the nozzle unit 112 and the print medium P may be about 0.5-2.5 mm.

A sensing unit 132 senses whether a defective (or malfunctioning) nozzle exists in the nozzle unit 112 disposed under the printhead 111. Here, the defective (or malfunctioning) nozzle may include a damaged nozzle, a missing nozzle, or a weak nozzle that cannot eject ink properly. That is, the defective nozzle exists when ink is not ejected from nozzles due to several causes, or when less than a normal amount of ink is ejected from a nozzle.

The sensing unit 132 may be installed to sense whether a defective nozzle exists in the nozzle unit 112 before the printing operation begins, or while the printing operation is being performed. Thus, the sensing unit 132 may include a first sensing unit 132A that senses whether a defective nozzle exists in the nozzle unit 112 before the printing operation starts, and a second sensing unit 132B that senses whether a defective nozzle exists in the nozzle unit 112 during the printing operation. The first sensing unit 132A senses whether nozzles are clogged by radiating light directly onto the nozzle unit 112, and the second sensing unit 132B senses whether a defective nozzle exists in the nozzle unit 112 by radiating light onto the print medium P. The structure and operation of the first sensing unit 132A may be similar to the structure and operation of the second sensing unit 132B. Thus, for explanation purposes, only the structure and operation of the second sensing unit 132B will be described here.

In general, a printhead of an inkjet image forming apparatus can be classified according to an actuator that provides an ejecting force to ink droplets. A first type of printhead is a thermal driving printhead that generates bubbles in the ink using a heater, thereby ejecting the ink droplets due to an expansion force of the bubbles. A second type of printhead is a piezoelectric driving printhead that ejects ink droplets using a pressure applied to the ink due to deformation of a piezoelectric device. When the ink is ejected using the thermal driving, the case in which (1) a heater that operates to eject the ink is short-circuited, (2) a driving circuit of the heater breaks down, and (3) defects of nozzles result from damage of electrical components such as a field emission transistor (and the like) can be easily sensed. Similarly, when ink is ejected using the piezoelectric driving, (1) defects of a piezoelectric device and (2) defects of nozzles that results from damage of a driving circuit that drives the piezoelectric device also can be easily sensed. The defects of the nozzles that result from the above causes can be sensed by the first sensing unit 132A before the printing operation is commenced.

On the other hand, the causes of a defective nozzle may not be easily sensed when the nozzle is clogged with foreign matters. When the causes of a defective nozzle cannot be easily sensed, a test page should be printed. If a defective nozzle exists in the nozzle unit 112, a print concentration of a portion of the print medium P that corresponds to the defective nozzle is lower than a portion of the print medium P printed by a normal (i.e., functioning) nozzle, due to missing dots on the print medium P. Since the portion of the print medium P having the lower print concentration can be sensed by the second sensing unit 132B, a position of the defective nozzle can be sensed using the second sensing unit 132B. That is, the defective nozzle can be sensed using the above-described methods both while printing a test page printing and/or while performing an actual image printing operation.

An optical sensor may be used as the second sensing unit 132B. For example, the optical sensor may include a light-emitting part (not shown), such as a light emitting diode that radiates light onto the print medium P, and a light-receiving sensor (not shown) that receives light reflected from the print medium P. An output signal from the light-receiving sensor is input to the second sensing unit 132B. The second sensing unit 132B senses whether a defective nozzle exists in the nozzle unit 112 in response to the output signal, and information about whether the defective nozzle exists in the nozzle unit 112 is transmitted to the controller 130. Accordingly, the sensing unit 132 senses whether the defective nozzle exists in the nozzle unit 112 using the above-described operations and/or processes. Here, the light-emitting part and the light-receiving sensor may be formed as a single body, or may be formed as separate components. The structure and operation of the optical sensor is should be known to those skilled in the art to which the present general inventive concept pertains, and thus, a detailed description thereof will not be provided here.

The printhead unit 105 prints an image by ejecting ink onto the print medium P. The printhead unit 105 includes the body 110, the printhead 111 disposed on the bottom surface of the body 110, the nozzle unit 112 disposed under the printhead 111, and the carriage 106 on which the body 110 is mounted. The body 110 having the printhead 111 is mounted in a cartridge shape on the carriage 106, and a carriage moving unit 142, which will be described later, reciprocates the carriage 106. The feeding roller 115 is installed at an inlet side of the nozzle unit 112, and the paper discharging roller 113 is installed at an outlet side of the nozzle unit 112. In addition, a cable may be connected to each of the nozzles in the nozzles unit 112 to transmit a driving signal generated by the controller 130, a power used to eject ink, print data, and the like. In this case, a flexible cable such as a flexible printed circuit (FPC) or a flexible flat cable (FFC) may be used.

Figure 3A:
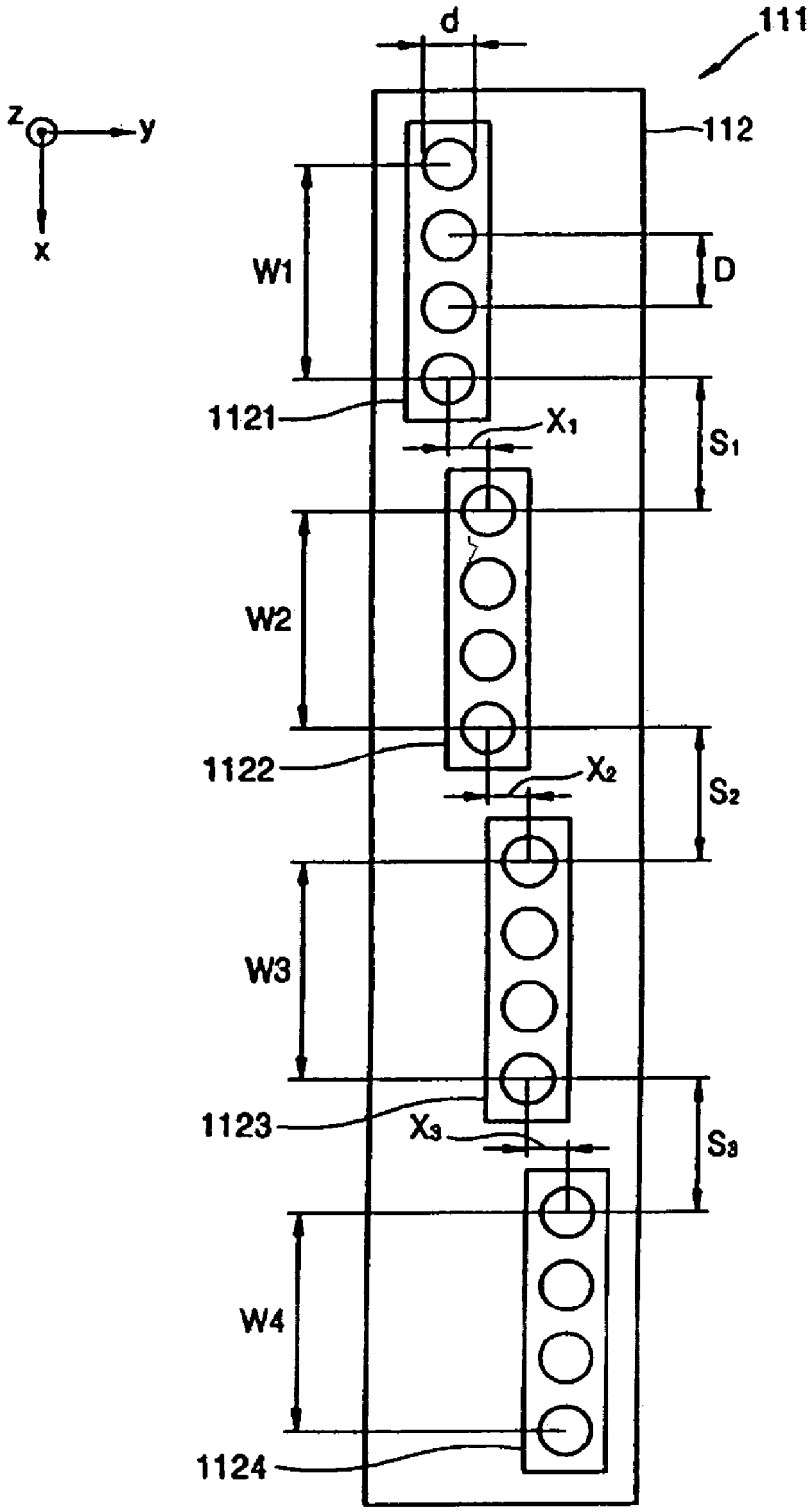
FIG. 3A is a bottom side view illustrating a printhead of the image forming apparatus of FIG. 2, according to an embodiment of the present invention.
Figure 3B:
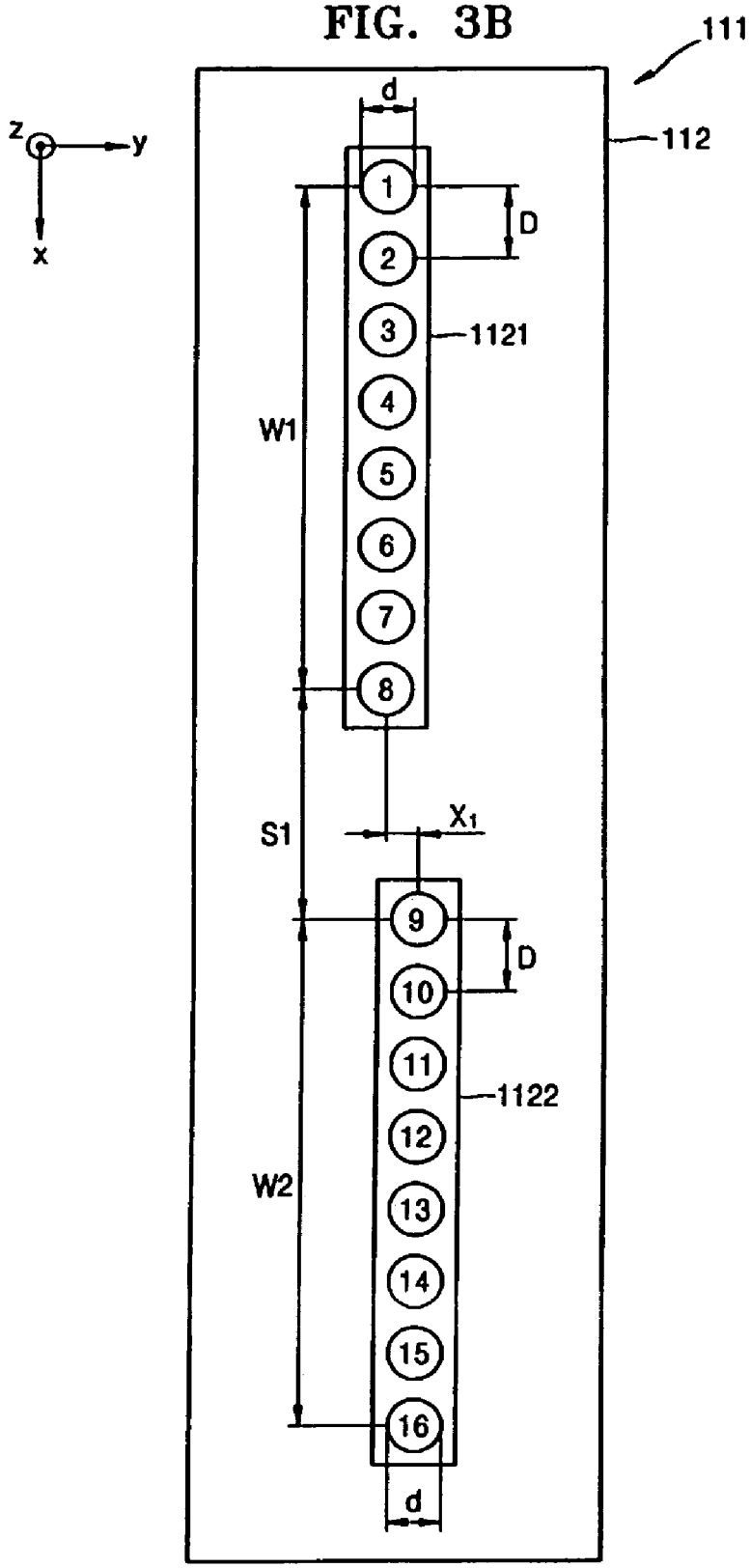
FIGS. 3B and 3C are bottom side views illustrating a printhead of the image forming apparatus of FIG. 2, according to other embodiments of the present general inventive concept.
Figure 3C:
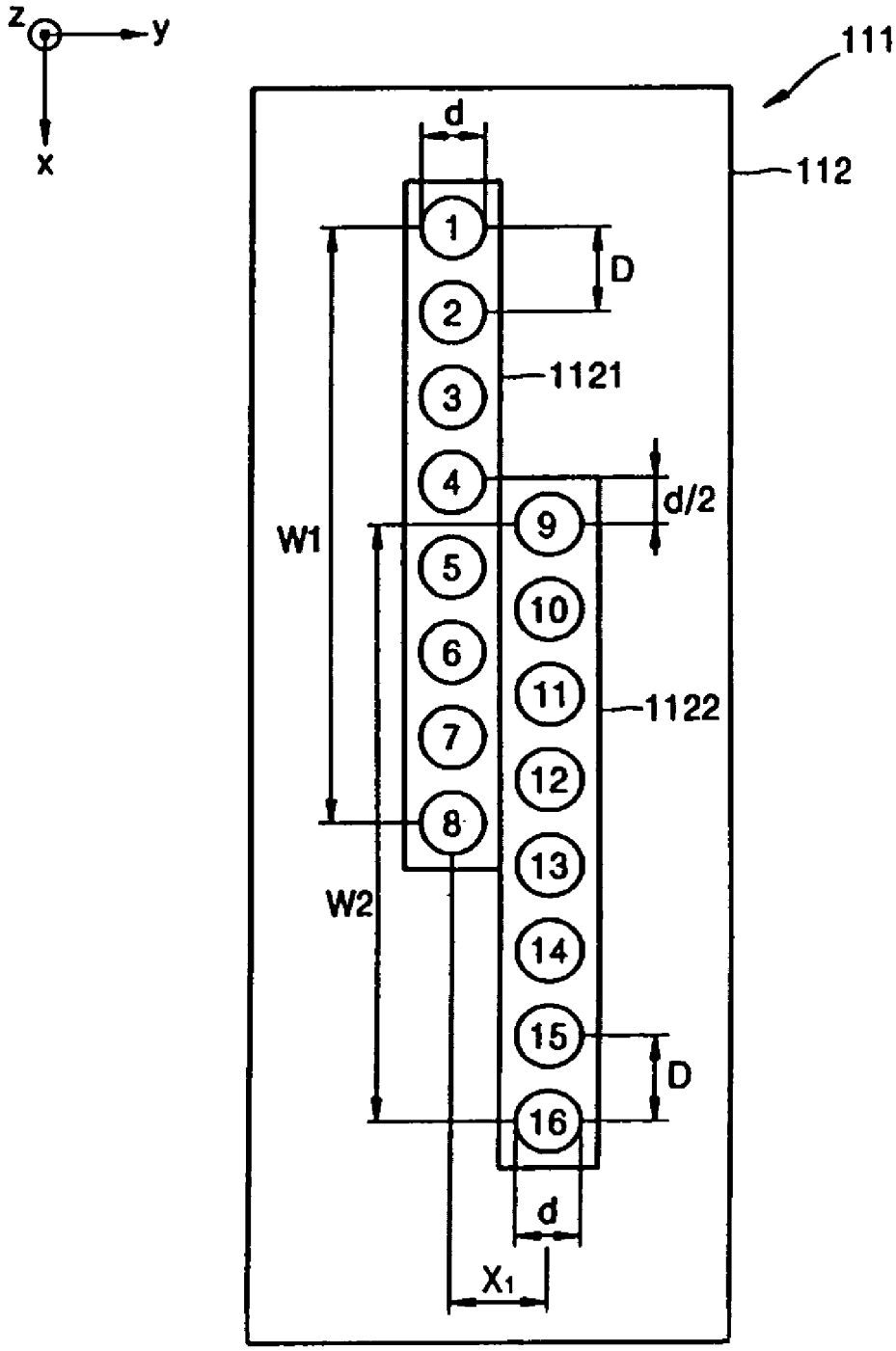

FIG. 3A is a bottom side view illustrating the printhead 111 of the image forming apparatus of FIG. 2, according to an embodiment of the present general inventive concept, and FIGS. 3B and 3C are bottom side views illustrating the printhead 111 of the image forming apparatus of FIG. 2, according to another embodiment of the present general inventive concept. For explanation purposes, like reference numerals represent like elements having similar structure and operation.

However, it should be understood that these embodiments may be different from one another in various respects, and that the image forming apparatus of FIG. 2 may use any one of these embodiments and/or other embodiments that achieve the purposes set forth herein. Additionally, the nozzle unit 112 illustrated in FIGS. 3A to 3C may include sub-nozzle units 1121, 1122, etc. The printhead 111 may include a plurality of nozzle units 112 arranged adjacent to one another along the main scanning direction such that the printhead 111 includes sub-nozzle units extending along both the main and subsidiary scanning directions. For purposes of explanation, the sub-nozzle units 1121, 1122, etc. are simply referred to as "nozzle units" 1121, 1122, etc.

The printhead 111 includes N nozzle units 112 disposed in a subsidiary scanning direction (x-direction). The printhead 111 makes a reciprocating motion in the main scanning direction (y-direction) and prints an image by ejecting ink onto the print medium P that is fed in the subsidiary scanning direction (x-direction). The printhead 111 uses thermal energy, a piezoelectric device, or the like, as a power source to eject the ink, and the printhead 111 may be manufactured to have a high actual resolution using semiconductor manufacturing processes including, for example, etching, deposition, sputtering, and/or the like.

A plurality of nozzles that print the image by ejecting the ink onto the print medium P are arrayed in each of the N nozzle units 112. Each of the N nozzle units 112 may overlap with one another in either direction to improve resolution. In addition, each of the N nozzle units 112 may include the same number of nozzles. That is, the width (in the subsidiary scanning direction) of each of the N nozzle units 112 may be the same. The ejection operation of the N nozzle units 112 is controlled by the controller 130. FIGS. 3A through 3C illustrate the printhead 111 to eject one color. However, it should be understood that these embodiments are exemplary and that the present general inventive concept is not limited to these arrangements. A color printhead that ejects two or more colors may be used in the present general inventive concept. In this case, two or more times the number of nozzle units N may be used in the printhead 111.

As described above, the printhead 111 includes the N nozzle units 112. As illustrated in FIG. 3A, for explanation purposes, the printhead 111 having four nozzle units 112 will be described. However, it should be understood that the description that follows may also be applied to the arrangements of FIGS. 3B and 3C.

In an embodiment of the present general inventive concept (refer to FIG. 3A for reference numbers), the N nozzle units 112 may be disposed so that a distance between centers of each of nozzles of the nozzle units 112 that are adjacent along the subsidiary scanning direction is increased by D×M+D/N from a nozzle unit 1121 at a first end of the printhead 111 (i.e., the first end nozzle unit 1121) to a nozzle unit 1124 at a second end of the printhead 111 (i.e., the second end nozzle unit 1124). Here, M is a predetermined integer, D is a nozzle pitch, and N is 4. M may be one of integers (for example, 0, 1, 2, 3, etc.) so that the term D×M represents a relative distance proportional to the nozzle pitch D by the integer M. If the N nozzle units 112 are disposed as described above, ink droplets ejected by each nozzle unit 112 are deposited to be adjacent in the subsidiary scanning direction (x-direction) so that a printing resolution in the subsidiary scanning direction can be improved. That is, if two nozzle units 112 having an actual resolution of 600 dpi (dots per inch) are disposed adjacent to each other as illustrated in FIGS. 3B and 3C, a printing resolution of 1200 dpi can be realized in the subsidiary scanning direction, since these two nozzle units extend along the printing medium transferring direction, which is the same as the subsidiary scanning direction (x-direction). In a similar manner, if four nozzle units 112 are disposed as illustrated in FIG. 3A, a printing resolution of 2400 dpi can be realized in the subsidiary scanning direction for the same reasons. These gains in printing resolution can be realized due to the fact that two or more nozzle units are used to print to the same region on the print medium P, and the two or more nozzle units correspond to the same region of the print medium P at two or more different times during the printing operation due to the movement of the carriage 106 along the main scanning direction (y-direction) and the transferring of the print medium P along the subsidiary scanning direction.

In addition, each of the N nozzle units 112 may be spaced apart from one another by a predetermined gap in the subsidiary scanning direction. That is, the nozzles of the adjacent nozzle units 112 may be spaced apart from one another by D/N in the subsidiary scanning direction.

Alternatively, the N nozzle units 112 may be disposed such that a distance between centers of each of nozzles of the nozzle units 112 adjacent in the main scanning direction is increased by d×L+d/N from the first end nozzle unit 1121 to the other-end nozzle unit 1124. Here, L is a predetermined integer, d is a diameter of a nozzle, and N is 4. L may be one of integers (for example, 0, 1, 2, 3, etc.) so that the term d×L represents a relative distance proportional to the diameter of a nozzle d by the integer L. If the N nozzle units 112 overlap with one another along the main scanning direction as described above, the printing resolution can be improved in the main scanning direction. That is, when the two nozzle units 112 having the actual resolution of 600 dpi are disposed as illustrated in FIG. 3B, a printing resolution of 1200 dpi can be realized in the main scanning direction. Similarly, if four nozzle units 112 are disposed in the printhead 111, as illustrated in FIG. 3A, a printing resolution of 2400 dpi can be realized in the subsidiary scanning direction.

When the N nozzle units 112 are disposed along the subsidiary scanning direction, the N nozzle units 112 need not also be disposed along the main scanning direction. Similarly, when the N nozzle units 112 are disposed along the main scanning direction, the N nozzle units 112 need not also be disposed along the subsidiary scanning direction. In order to improve the printing resolution in both the main scanning direction and the subsidiary scanning direction, the N nozzle units 112 may be disposed such that the nozzles of the adjacent nozzle units 112 may be spaced apart from one another in the subsidiary scanning direction and the main scanning direction (i.e., the adjacent nozzle units 112 are complementarily disposed), as illustrated in the embodiments of FIGS. 3A and 3B.

For a better understanding, the arrangement and operation of the printhead 111 will now be described with reference to the accompanying drawings.

Referring to FIG. 3A, four nozzle units (e.g., sub-nozzle units) 1121, 1122, 1123, and 1124 each having four nozzles are disposed along the subsidiary scanning direction. W1, W2, W3, and W4 are widths of each of the nozzle units 1121, 1122, 1123, and 1124 and regions to be printed on the print medium P when the printhead 111 is scanned (i.e., moved across the print medium P) once. The widths W1, W2, W3, and W4 of each of the nozzle units 1121, 1122, 1123, and 1124 may be the same. S1, S2, and S3 are distances between each of the nozzle units 1121, 1122, 1123, and 1124 that are adjacent in the subsidiary scanning direction. S1, S2, and S3 may be a distance of D×M+D/4. Here, S1, S2, and S3 may be the same. When the nozzle units 112 are disposed as described above, a printing resolution that corresponds to four times the actual resolution can be realized in the subsidiary scanning direction. X1, X2, and X3 are distances in the main scanning direction between centers of each of the nozzles of the nozzle units 1121, 1122, 1123, and 1124 that are adjacent to each other in the main scanning direction. X1, X2, and X3 may refer to a relative offset between the nozzle units 1121, 1122, 1123, and 1124, respectively, along the main scanning direction. X1, X2, and X3 may be a distance of D×L+d/4. Here, X1, X2, and X3 may be the same. When the nozzle units 112 are arranged as described above, a printing resolution that corresponds to four times the actual resolution can be realized in the main scanning direction.

As described above, since the printhead 111 exhibits the same effect when nozzles are disposed apart from one another by X1 in the main scanning direction, as when the nozzles are disposed apart from one another by D/N in the subsidiary scanning direction, images having a higher resolution can be printed.

As illustrated in FIGS. 3B and 3C, the N nozzle units 112 may include two nozzle units 1121 and 1122 in consideration of a printing speed and a printing efficiency. That is, the N nozzle units 112 may include a first nozzle unit 1121 and a second nozzle unit 1122. The arrangement and operation of the printhead 111 illustrated in FIGS. 3B and 3C are similar to those of the printhead 111 illustrated in FIG. 3A, and thus, a detailed description thereof will not be provided here. In the printhead 111 of FIG. 3B, the two nozzle units 1121 and 1122 are complementarily disposed in the main scanning direction (y-direction) and the subsidiary scanning direction (x-direction). In the printhead 111 of FIG. 3C, the nozzle units 1121 and 1122 are complementarily disposed only in the subsidiary scanning direction (x-direction). The printhead 111 of FIGS. 3A, 3B, and 3C illustrate exemplary embodiments of the present general inventive concept, and it should be understood that these embodiments are not intended to limit the scope of the present general inventive concept. The printhead 111 may have a variety of other shapes according to the present general inventive concept.

Although not illustrated, a storage space to receive ink is disposed in the body 110. An ink-storing space is formed in a cartridge shape in the body 110 to be attachable and detachable. The body 110 may further include a chamber having a an ejecting unit to communicate with each of nozzles of the nozzle units 112 and to apply pressure to eject ink, such as piezoelectric device and a thermal driving heater, a passage such as an orifice to supply the ink received in the body 110 to the chamber, a manifold which is a common passage to supply the ink that flows in via the passage to the chamber, and a restrictor which is a separate passage to supply the ink to each chamber from the manifold, and the like. The chamber, the ejecting unit, the passage, the manifold, the restrictor, and the like should be known to those skilled in the art to which the present general inventive concept pertains, and thus, a detailed description thereof will not be provided here.

Figure 4:
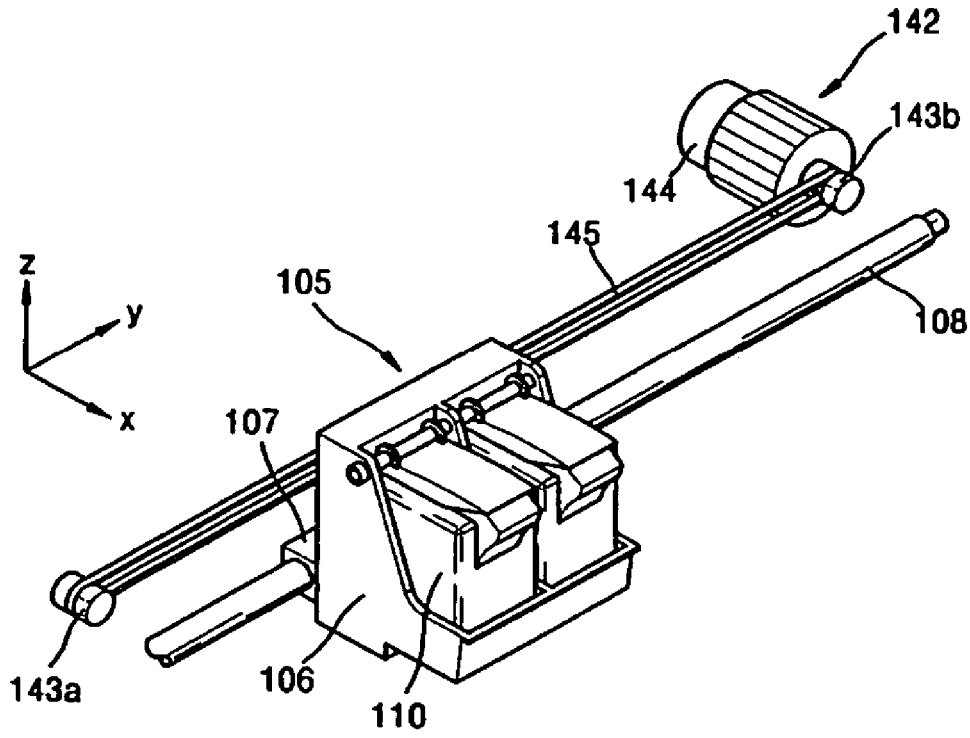
FIG. 4 is a perspective view illustrating a printhead unit and a carriage moving unit of the image forming apparatus of FIG. 2, according to an embodiment of the present general inventive concept.

FIG. 4 is a perspective view illustrating the printhead unit 105 and a carriage moving unit 142 of the image forming apparatus of FIG. 2, according to an embodiment of the present general inventive concept. Referring to FIGS. 2 and 4, the body 110 is mounted on the carriage 106. The printhead 111 is mounted on the carriage 106 in a cartridge shape and is connected to the body 110. The carriage moving unit 142 moves the carriage 106 in a reciprocating motion along the main scanning direction. The carriage moving unit 142 includes a carriage moving motor 144, carriage moving rollers 143*a* and 143*b*, and a carriage moving belt 145. A power is supplied from a main body of the image forming apparatus to the carriage moving motor 144. One side of each of the carriage moving rollers 143*a* and 143*b* is connected to the carriage moving motor 144, and the other side thereof is installed on a main frame (not shown). The carriage moving belt 145 is supported by the carriage moving rollers 143*a* and 143*b* and travels around an endless track. The carriage 106 is combined with the carriage moving belt 145. The carriage 106 moves to a predetermined position in response to a control signal transmitted from the controller 130 to the carriage moving motor 144. The reciprocating motion of the carriage 106 is guided by a guide shaft 108. The guide shaft 108 guides the reciprocating motion of the carriage 106 driven by the carriage moving motor 144. A combining unit 107 into which the guide shaft 108 is inserted is disposed at one side of the carriage 106. The combining unit 107 is perforated at one side of the carriage 106. The guide shaft 108 is inserted into the combining unit 107 formed in a hollow shape and guides the reciprocating motion of the carriage 106.

Figure 5:
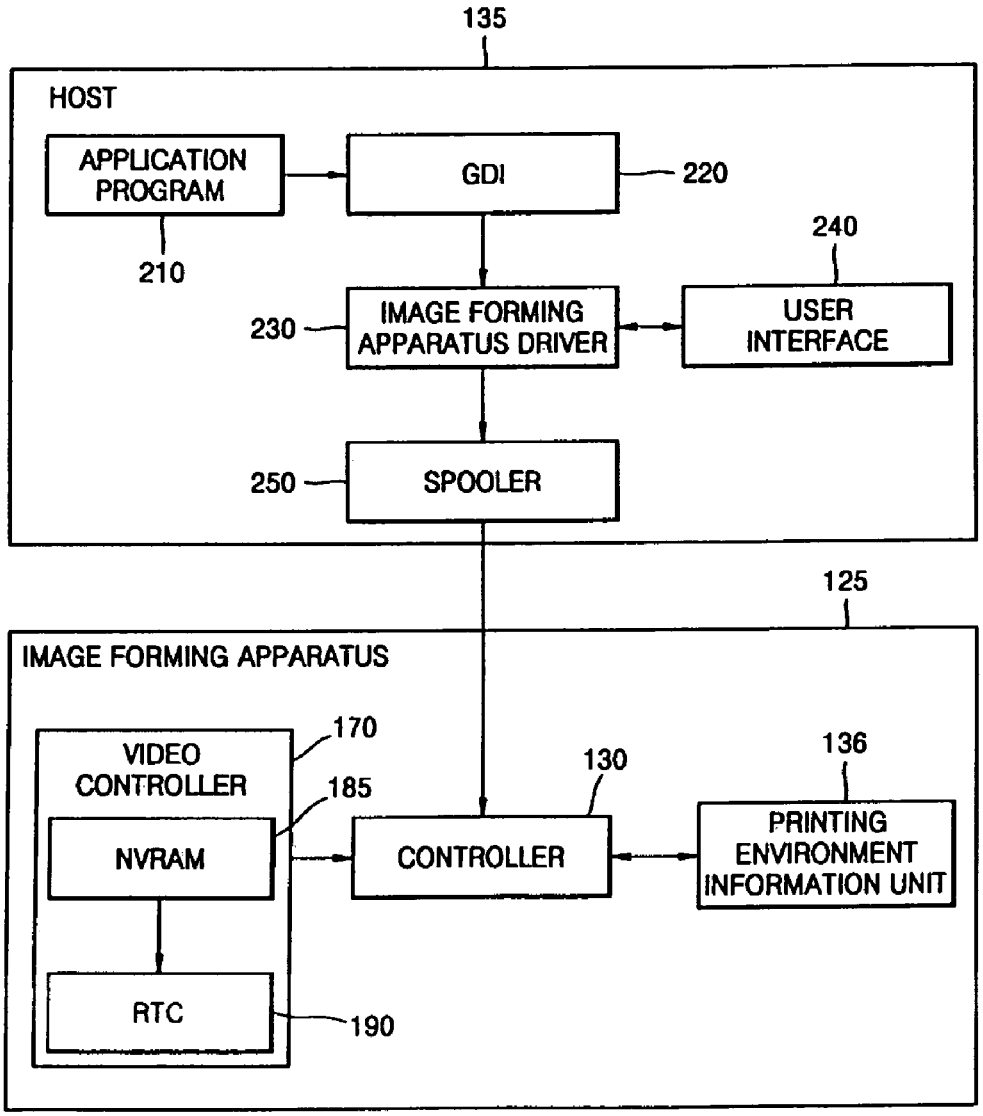
FIG. 5 is a block diagram illustrating an image forming system according to another embodiment of the present general inventive concept.
Figure 6:
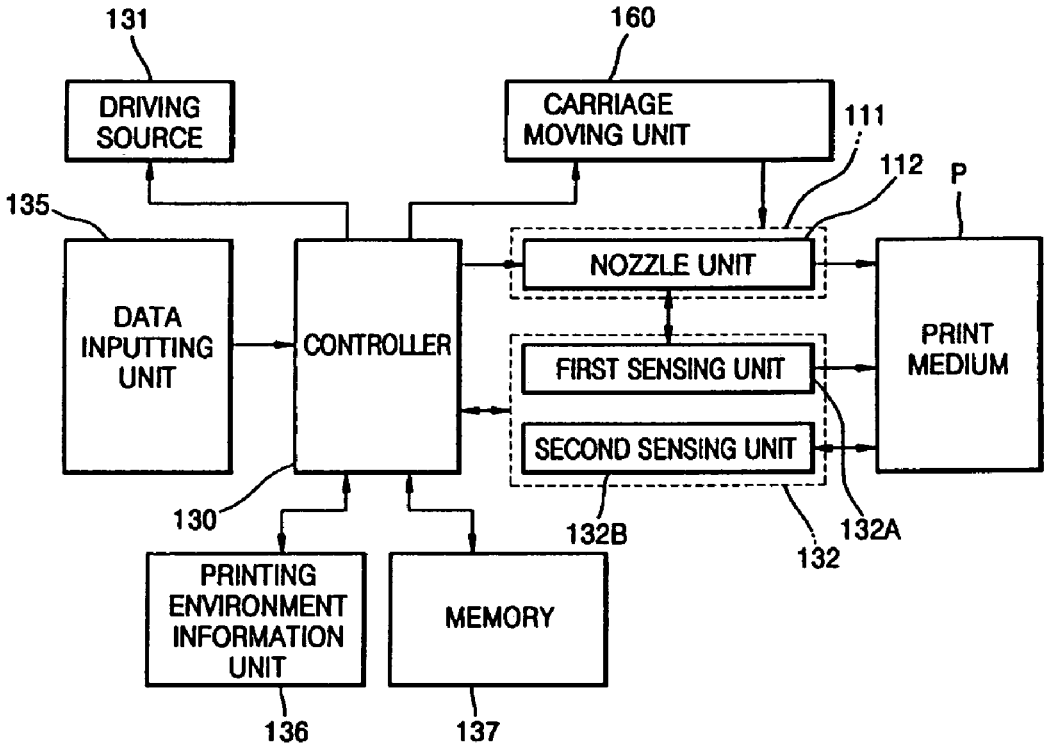
FIG. 6 is a block diagram illustrating operation of the image forming system of FIG. 5, according to another embodiment of the present general inventive concept.

FIG. 5 is a block diagram illustrating an image forming system according to another embodiment of the present general inventive concept, and FIG. 6 is a block diagram illustrating operation of the image forming system of FIG. 5. Here, the image forming system includes a data inputting unit 135 and an inkjet image forming apparatus 125. The image forming apparatus 125 of the image forming system of FIGS. 5 and 6 may be similar to the image forming apparatus 125 of FIG. 2. Accordingly, similar reference numbers are used, and the image forming system of FIGS. 5 and 6 are described with reference to FIG. 2.

Referring to FIGS. 2, 5, and 6, the data inputting unit 135 may be a host system such as a personal computer (PC), a digital camera, or a personal digital assistant (PDA). Image data to be printed is input to the data inputting unit 135 in an order of pages to be printed. The data inputting unit 135 includes an application program 210, a graphics device interface (GDI) 220, an image forming apparatus driver 230, a user interface 240, and a spooler 250. The application program 210 generates an object that can be output using the image forming apparatus 125 and edits the object. The GDI 220 is a program that runs on an operating system (OS) on the host system. The GDI 220 transmits the object generated by the application program 210 to the image forming device driver 230, and generates commands related to the object that the image forming apparatus driver 230 requests.

The image forming apparatus driver 230 is a program that runs on the host system and generates printer commands that can be interpreted by the image forming apparatus 125. The user interface 240 for the image forming apparatus driver 230 is a program that runs on the host system and provides an environmental variable in which the image forming apparatus driver 230 generates the printer commands. The spooler 250 is a program that runs on the operating system in host system and transmits the printer commands generated by the image forming apparatus driver 230 to an input/output device (not shown) connected to the image forming apparatus 125.

The image forming apparatus 125 includes a video controller 170, the controller 130, and a printing environment information unit 136. In addition, the video controller 170 includes a non-volatile random access memory (NVRAM) 185 and a real time clock (RTC) 190.

The video controller 170 interprets and bitmaps the printer commands generated by the image forming apparatus driver 230 and then transmits the interpreted printer commands to the controller 130. The controller 130 transmits the bitmaps generated by the video controller 170 to each element of the image forming apparatus 125 to form an image on the print medium P. A printing operation is performed in the image forming apparatus 125 using the above-described procedure.

The controller 130 is disposed on a motherboard of the image forming apparatus 125 and controls an ejection operation of the nozzle units 112 disposed under the printhead 111, an operation of the print medium-feeding units 113, 115, 116, and 117, and an operation of the carriage 106. That is, the controller 130 synchronizes the operation of each element so that ink ejected from the nozzle units 112 can be deposited on a predetermined portion of the print medium P while the printhead 111 moves in the main scanning direction when the printing operation is performed with a predetermined resolution. The controller 130 stores the image data input through the data inputting unit 135 in a memory 137 and checks whether the image data to be printed has been completely stored in the memory 137.

The printing environment information unit 136 stores a plurality of printing environment information that correspond to each printing environment when the image data is input from the application program 210 in a predetermined printing environment. That is, the printing environment information unit 136 stores printing environment information that corresponds to each type of printing environment input to the user interface 240. Here, the printing environment information may include at least one of a printing density, a resolution, a size of the print medium P, a type of the printing medium P, a temperature, a humidity, and a continuous printing. Thus, the printing environment information unit 136 stores various printing environment information settings to correspond to each type of printing environment that could be input via the user interface 240. The controller 130 controls the operations of the printhead 111, the carriage 106, and the print medium-feeding units 113, 115, 116, and 117 in each printing environment stored in the printing environment information unit 136 that corresponds to the printing environment input via the user interface 240.

If the image data has been completely stored in the memory 137, the controller 130 operates the driving source 131 by generating a control signal that corresponds to the input printing environment. The print medium P is fed by the print medium-feeding units 113, 115, 116, and 117 driven by the driving source 131. The print medium P is transferred along the predetermined path to the nozzle units 112. The controller 130 moves the printhead 111 in the main scanning direction according to the printing environment stored in the printing environment information unit 136 that corresponds to the printing environment input via the user interface 240. In addition, the controller 130 generates control signals to control the ejection operation of the nozzle units 112, and the nozzle units 112 print the image data on the print medium P in response to the control signals. The controller 130 performs the printing operation according to the printing environment information stored in the printing environment information unit 136 and information about a defective nozzle sensed by the sensing unit 132.

A printing method using the printing environment input from the user interface 240 and the information about the defective nozzle sensed by the sensing unit 132 will be described with reference to the embodiment illustrated in FIG. 3B. In FIG. 3B, reference numerals 1, 2, 3, 4, 5, and . . . 16, respectively, represent nozzles arrayed in the first nozzle unit 1121 and the second nozzle unit 1122.

The controller 130 controls the operation of each element so as to use different printing methods according to (1) the printing environment input from the user interface 240 and (2) whether the defective nozzle is sensed by the sensing unit 132.

Referring to FIG. 3B, when the printing operation is performed with an actual resolution or the defective nozzle is not sensed by the sensing unit 132, the controller 130 may perform the printing operation using the first nozzle unit 1121. That is, the controller 130 generates a control signal to drive the first nozzle unit 1121 so that the printhead 111 moves in the main scanning direction and prints an image by ejecting ink from the first nozzle unit 1121. After a scanning operation has been completely performed as described above, the printhead 111 moves back to an initial position. The controller 130 feeds the print medium P in the subsidiary scanning direction before a next scanning operation is performed. In this case, the controller 130 feeds the print medium P by a width W1 of the first nozzle unit 1121 and then begins the next scanning operation using the first nozzle unit 1121. When the printing operation is performed with the actual resolution or the defective nozzle is not sensed by the sensing unit 132, the above-described procedure is repeatedly performed and the image is printed.

When the printing environment input via the user interface 240 indicates a higher resolution printing or the defective nozzle is sensed by the sensing unit 132, the printing operation may be performed using processes that are different from the above-described processes.

First, a method of printing with a higher resolution will now be described. If a printing environment indicating a higher resolution printing is input via the user interface 240, the operation of the printhead 111 is controlled according to a printing resolution stored in the printing environment information unit 136 that corresponds to the higher resolution. Accordingly, the controller 130 performs the printing operation using both the first nozzle unit 1121 and the second nozzle unit 1122. In this case, the second nozzle unit 1122 performs the printing operation in a region that has already been printed by the first nozzle unit 1121 such that the higher resolution can be realized. That is, if the print medium P reaches the printhead 111, the first nozzle unit 1121 moves along the main scanning direction and prints a region that corresponds to the width W1 (i.e., a first printing operation is performed on the region). After an initial scanning operation (i.e., including the first printing operation) has been completed as described above, the printhead 111 moves back to the initial position (e.g., at one side of the print medium P). The controller 130 then controls the print medium-feeding units 113, 115, 116, and 117 to feed the print medium P in the subsidiary scanning direction by the width W1 of the first nozzle unit 1121 before the next scanning operation is performed. In the next scanning operation, the first nozzle unit 1121 prints to another region that corresponds to the width W1, and the second nozzle unit 1122 performs a second printing operation on the region that has already been printed to by the first nozzle unit 1121 during a previous scanning operation. In this case, ink droplets ejected by the second nozzle unit 1122 are deposited at positions that are adjacent to ink droplets ejected by the first nozzle unit 1121 in both the main scanning direction and the subsidiary scanning direction. That is, the printhead 111 performs the printing operation with a resolution of X1 in the main scanning direction and with a resolution of D/N in the subsidiary scanning direction, since the nozzle units 1121, 1122, etc. are complementarily arranged. In the present embodiment, the printhead 111 performs the printing operation with a resolution of d/2 in the main scanning direction and with a resolution of D/2 in the subsidiary scanning direction.

Figure 7:
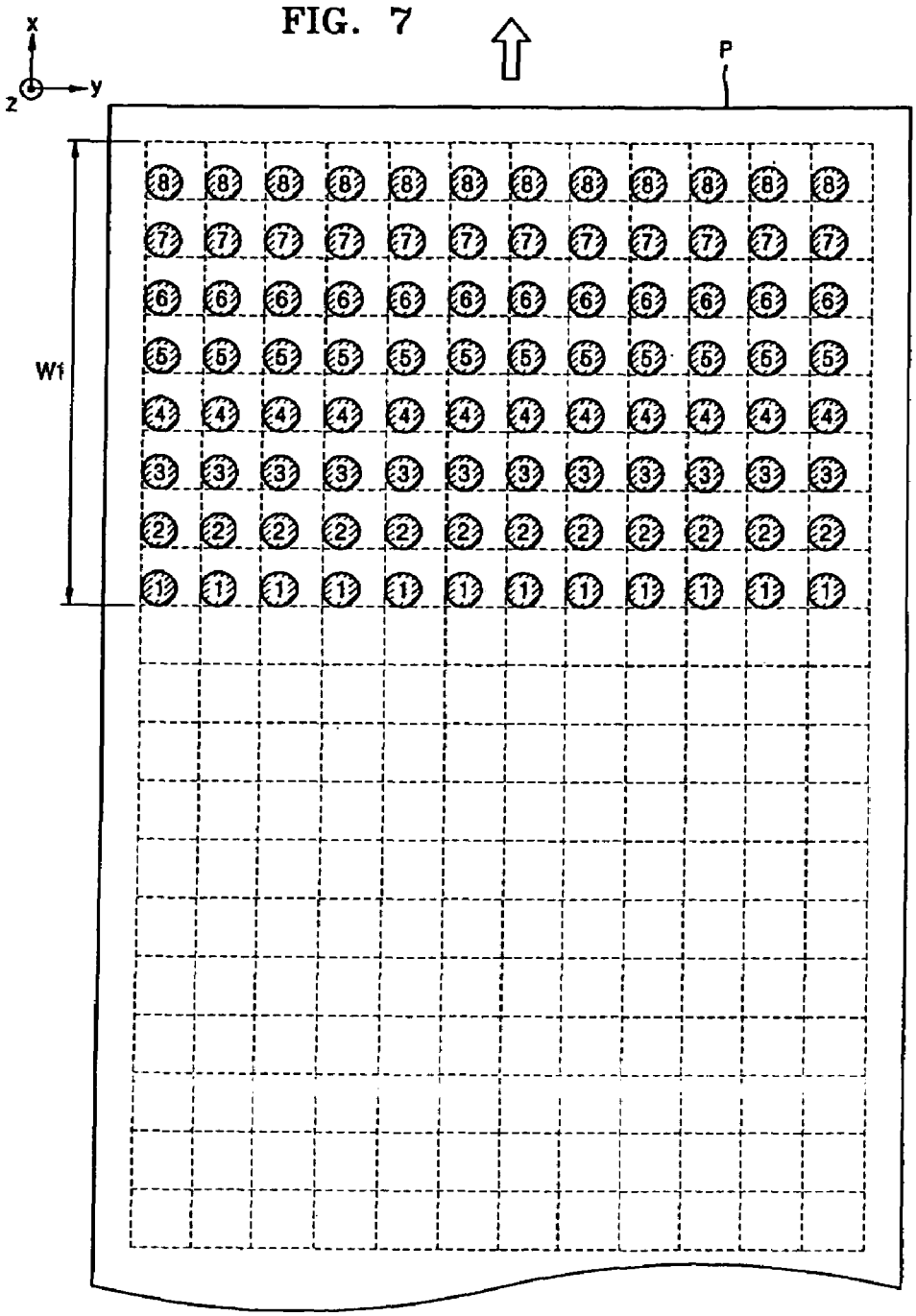
FIG. 7 illustrates printing patterns printed by a one-time scanning operation performed by the printhead of FIG. 3B, according to an embodiment of the present general inventive concept.
Figure 8:
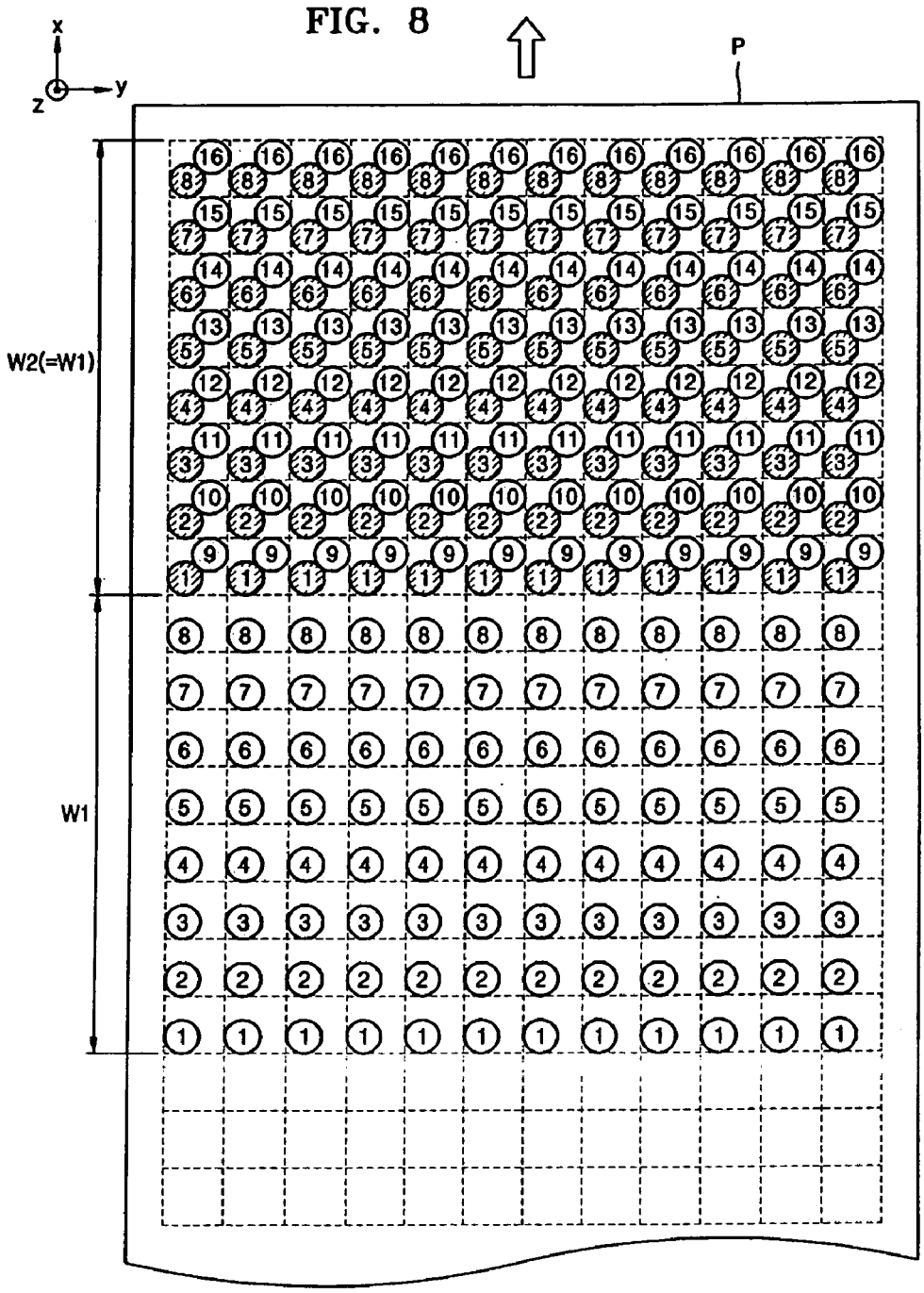
FIG. 8 illustrates printing patterns printed by a two-time scanning operation performed by the printhead of FIG. 7, according to another embodiment of the present general inventive concept.
Figure 9:
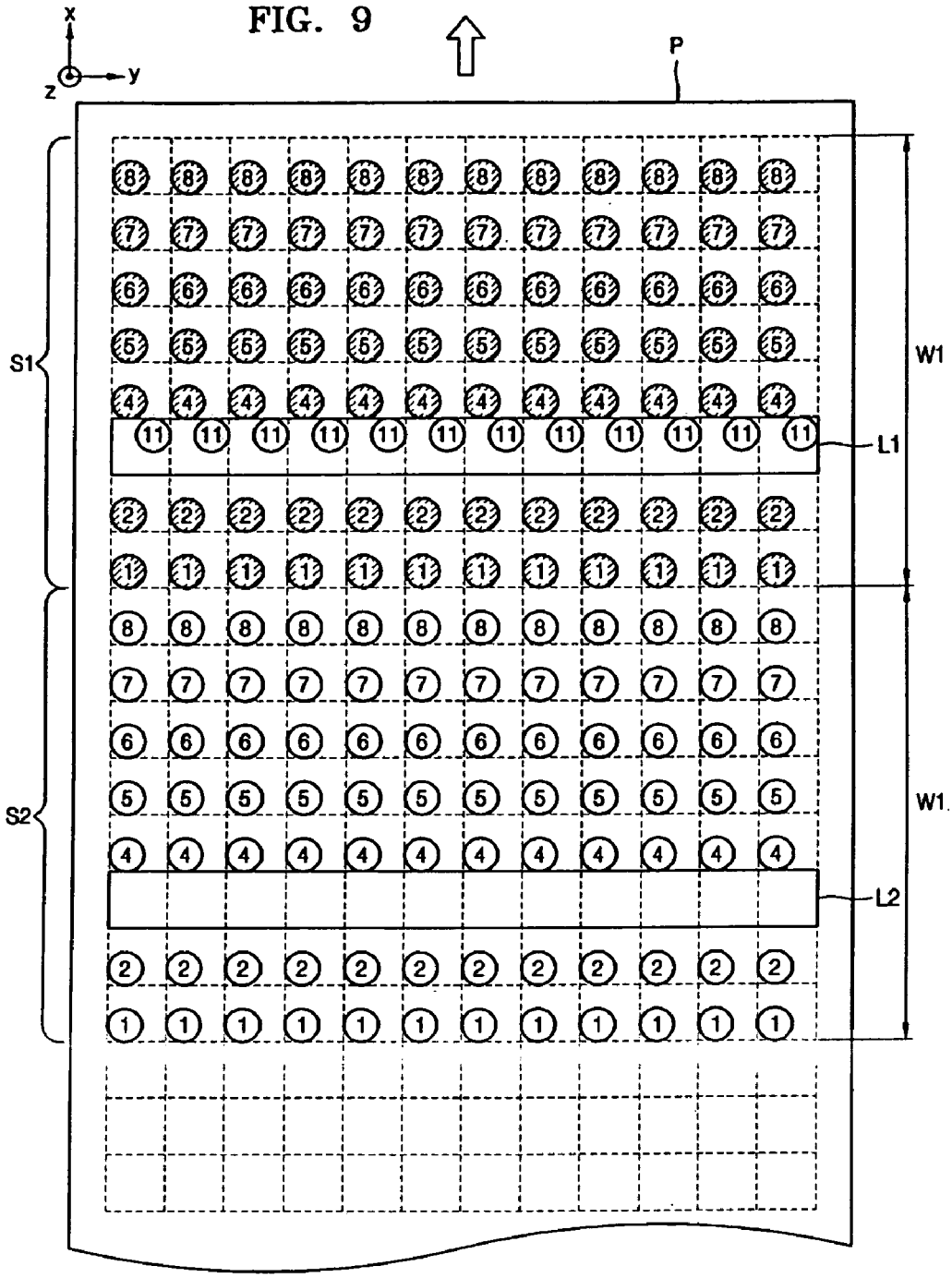
FIG. 9 illustrates printing patterns in which a defective nozzle existing in a first nozzle unit of the printhead of FIG. 3B is compensated for by a second nozzle unit of the printhead, according to an embodiment of the present general inventive concept.

FIG. 7 illustrates printing patterns printed by a one-time scanning (e.g., a first scanning operation) performed by the printhead 111 illustrated in FIG. 3B. FIG. 8 illustrates printing patterns printed by a two-time scanning (e.g., first and second scanning operations) performed by the printhead 111 illustrated in FIG. 3B. FIG. 9 illustrates printing patterns in which a defective nozzle exists in the first nozzle unit 1121 of the printhead 111 illustrated in FIG. 3B is compensated for by the second nozzle unit 1122. In the drawings, 1, 2, 3, 4, . . . 8 represent ink dots ejected from nozzles 1, 2, 3, 4, . . . 16, respectively, of the first nozzle unit 1121 and the second nozzle unit 1122. The print medium P is fed in a direction of an arrow. In addition, ink dots deposited during a first scanning operation and ink dots deposited during a second scanning operation are illustrated as having different shapes. For example, the ink dots deposited during the first scanning operation have a shaded circular shape, and the ink dots deposited during the second scanning operation have an unshaded circular shape.

Referring to FIG. 7, the printhead 111 moves in the main scanning direction (y-direction) during the first scanning operation and prints a region (i.e., a first region) that corresponds to a width W1 of the first nozzle unit 1121. After the first scanning operation has been completely performed, the print medium P is fed in the subsidiary scanning direction (x-direction) by the width W1 of the first nozzle unit 1121. Then, as illustrated in FIG. 8, an image is printed on the print medium P using both the first nozzle unit 1121 and the second nozzle unit 1122. In FIG. 8, second ink droplets ejected by the second nozzle unit 1122 are deposited to be spaced apart from first ink droplets ejected by the first nozzle unit 1121 by d/2 in the main scanning direction, and are deposited to be spaced apart from the first ink droplets by D/2 in the subsidiary scanning direction. Thus, by using the printhead 111 according to the present embodiment, the higher resolution can be realized. In other words, during the first scanning operation, the first nozzle unit 1121 ejects ink droplets to the first region of the print medium P. During the second scanning operation, the first nozzle unit 1121 ejects ink droplets to a second region of the print medium that is adjacent to the first region while the second nozzle unit 1122 ejects ink droplets onto the first region.

A printing method used when a defective nozzle is sensed by the sensing unit 132 will now be described. A method of sensing a defective nozzle is described above, and thus, a detailed description thereof will not be provided.

When performing the printing operation with an actual resolution, the image forming apparatus 125 performs the printing operation using the first nozzle unit 1121 of the printhead 111. If a defective nozzle exists in the first nozzle unit 1121, since ink has not been deposited in a region that corresponds to the defective nozzle, a missing line, such as a white line may be formed in the main scanning direction. The missing line can be easily seen, and thus should be compensated for.

If the defective nozzle does not exist in the first nozzle unit 1121, the controller 130 operates the first nozzle unit 1121 so that ink is ejected when the print medium P reaches the printhead 111. The controller 130 generates and outputs control signals for to control the operation of the first nozzle unit 1121 so that the image data is printed on the print medium P, and the first nozzle unit 1121 prints the image data on the print medium P in response to the control signals.

If the defective nozzle exists in the first nozzle unit 1121, the controller 130 compensates for the defective nozzle using a nozzle in the second nozzle unit 1122 that corresponds to a position of the defective nozzle in the first nozzle unit 1121. The compensation nozzle may have a position within the second nozzle unit 1122 that corresponds to a position of the defective nozzle within the first nozzle unit 1121. The case in which a nozzle 3 of the first nozzle unit 1121 illustrated in FIG. 3B is defective will now be described. Referring to FIG. 9, ink is not deposited in a line L1 printed by the nozzle 3 of a region S1 printed by the first nozzle unit 1121 during the first scanning operation. After the first scanning operation has been completely performed, the print medium P is fed by the width W1 of the first nozzle unit 1121 in the subsidiary scanning direction (x-direction). The second scanning operation is then performed. In the second scanning operation, a new region S2 is printed by the first nozzle unit 1121, and ink is not deposited in a line L2 printed by the nozzle 3. Simultaneously, the line L1 of the region S1 printed during the first scanning operation is compensated for by a nozzle 11 of the second nozzle unit 1122. That is, the defective nozzle is compensated for using the nozzle of the second nozzle unit 1122 that corresponds to the defective nozzle that exists in the first nozzle unit 1121. The controller 130 may select the compensation nozzle in the second nozzle unit 1122 based on a signal received from the sensing unit 132.

Figure 10:
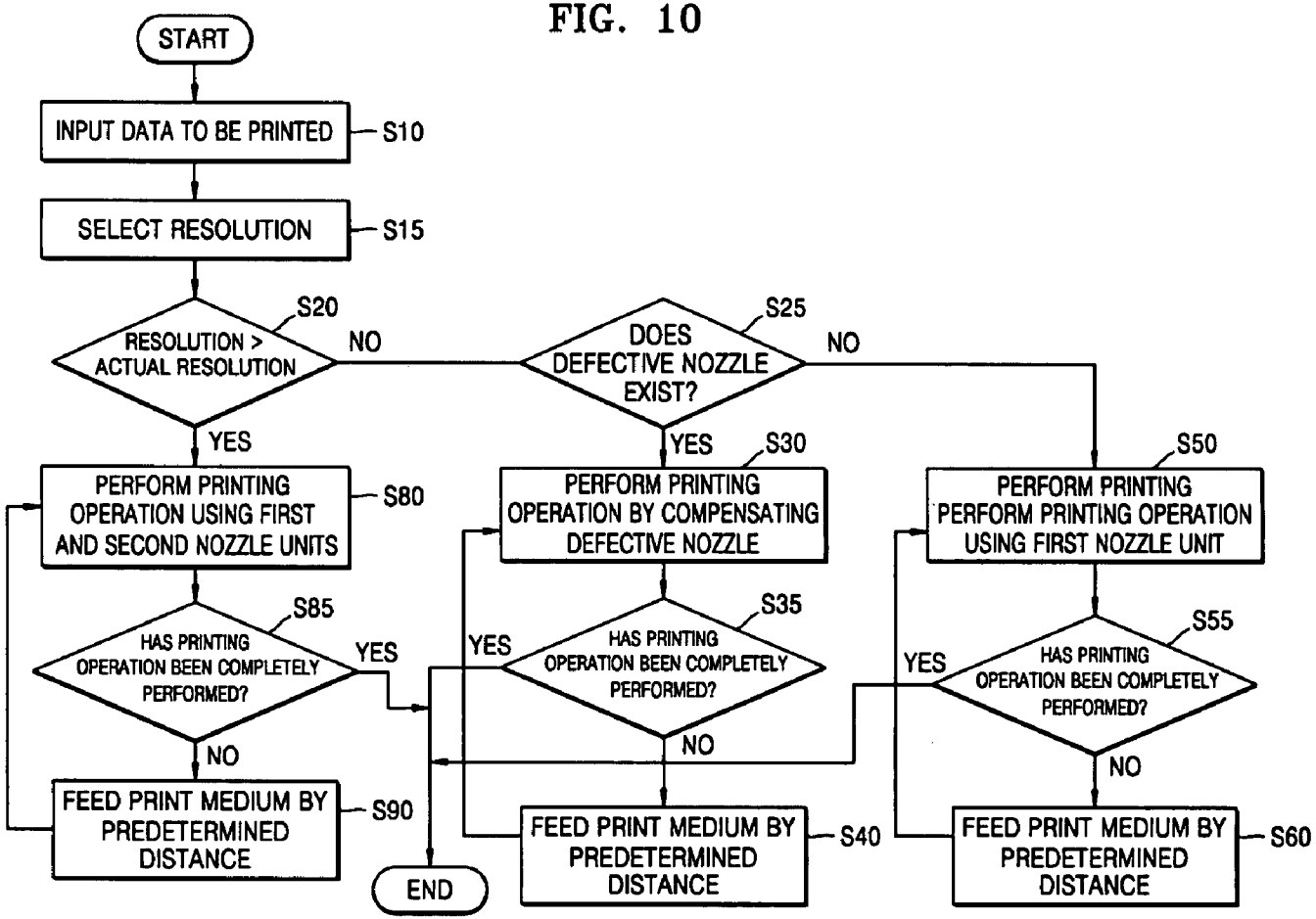
FIG. 10 is a flowchart illustrating a method of performing a printing operation with high resolution using an inkjet image forming apparatus according to another embodiment of the present general inventive concept.

For a better understanding of the explanation, the above-described processes are illustrated as a flowchart. FIG. 10 is a flowchart illustrating a method of printing with high resolution according to an embodiment of the present general inventive concept. The method of FIG. 10 can be performed by the image forming apparatus 125 of FIGS. 2 and 5 and/or the image forming system of FIG. 6. Accordingly, for illustration purposes, the method of FIG. 10 is illustrated with reference to FIGS. 2 to 10.

Referring to FIGS. 2 to 10, in operation S10, data to be printed is input from a host. In operation S15, a user selects a resolution using the user interface 240. In this case, the selected resolution and the actual resolution of the printhead 111 may be different. Thus, in operation S20, the image forming apparatus compares the selected resolution with the actual resolution of the printhead 111.

When the selected resolution is the same as the actual resolution, the sensing unit 132 senses whether a defective nozzle exists in the first nozzle unit 1121 in operation S25. If the defective nozzle exists in the first nozzle unit 1121, the defective nozzle is compensated for using the second nozzle unit 1122 in operation S30 and the printing operation is performed as described above with reference to FIG. 9. After determining whether the printing operation has been completely performed in operation S35, if the printing operation has not been completely performed, the print medium P is fed by the width W1 of the first nozzle unit 1121 in operation S40, and accordingly, the above-described processes are repeatedly performed. If the defective nozzle does not exist in the first nozzle unit 1121, the printing operation is performed using the first nozzle unit 1121 in operation S50. After determining whether the printing operation has been completely performed in operation S55, if the printing operation has not been completely performed, the print medium P is fed by the width W1 of the first nozzle unit 1121 in operation S60, and accordingly, the above-described processes are repeatedly performed.

When the selected resolution is higher than the actual resolution, the printing operation is performed using the first nozzle unit 1121 and the second nozzle unit 1122 in operation S80 as described above with reference to FIG. 8. After determining whether the printing operation has been completely performed in operation S85, if the printing operation has not been completely performed, the print medium P is fed by the width W1 of the first nozzle unit 1121 in operation S90, and accordingly, the above-described processes are repeatedly performed.

In the above-described configuration and methods, N nozzle units are separately disposed so that a second region that is adjacent to a first region that is printed by a first nozzle unit can be printed using a second nozzle unit. Thus, a printing operation can be performed with an actual resolution or a higher resolution while a print medium is fed by a width of the first nozzle unit. In addition, missing dots generated by a defective nozzle can be properly compensated for using the second nozzle unit.

As described above, in a printhead, a scanning type inkjet image forming apparatus having the same, and a method of performing the printing operation with high resolution according to various embodiments of the present general inventive concept, separate N nozzle units are properly disposed such that an image can be printed with a higher resolution than an actual resolution of the nozzle units, which is depends on a nozzle pitch D. For example, the N nozzle units can be disposed apart by D/N in a subsidiary scanning direction and apart by a d/N in a main scanning direction such that the higher resolution is N-times greater than the actual resolution. In addition, a printing operation can be performed with the actual resolution or the higher resolution while the print medium P is fed at a uniform speed such that the printing speed can be increased when the printing operation is performed with the higher resolution. In addition, when a portion of nozzles of a first nozzle unit is damaged, the portion of the nozzles in the first nozzle unit can be compensated for using a second nozzle unit such that an image quality is not affected by a damaged or malfunctioning nozzle.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A scanning type printhead movable along a main scanning direction, the printhead comprising:

N nozzle units having a plurality of nozzles arrayed in a subsidiary scanning direction perpendicular to the main scanning direction such that the N nozzle units are adjacent to one another in a subsidiary scanning direction, and the N nozzle units being disposed such that a distance along the subsidiary scanning direction between centers of nozzles of the adjacent nozzle units is about D×M+D/N from a nozzle unit disposed at a first end of the printhead to a nozzle unit disposed at a second end of the printhead opposite to the first end, where M is a predetermined integer and D is a nozzle pitch.

2. The scanning type printhead of claim 1, wherein each of the N nozzle units is spaced apart from one another in the subsidiary scanning direction by a predetermined gap.

3. The scanning type printhead of claim 1, wherein each of the N nozzle units includes the same number of nozzles.

4. The scanning type printhead of claim 1, wherein the N nozzle units are disposed such that a distance along the main scanning direction between centers of the nozzles of the adjacent nozzle units is about d×L+d/N from the first end nozzle unit to the second nozzle unit, where L is a predetermined integer and d is a diameter of a nozzle.

5. The scanning type printhead of claim 1, wherein the N nozzle units include a first nozzle unit and a second nozzle unit.

6. A scanning type printhead movable along a main scanning direction, the printhead comprising:

N nozzle units having a plurality of nozzles arrayed in a subsidiary scanning direction perpendicular to the main scanning direction, and the N nozzle units being disposed such that a distance along the main scanning direction between centers of nozzles of the nozzle units that are adjacent to each other is about d×L+d/N from a nozzle unit disposed at a first end of the printhead to a nozzle unit disposed at a second end of the printhead, where L is a predetermined integer and d is a diameter of a nozzle.

7. A scanning type inkjet image forming apparatus comprising:

a printhead movable in a main scanning direction and including N nozzle units having a plurality of nozzles arrayed in a subsidiary scanning direction;

a print medium-feeding unit to feed a print medium in the subsidiary scanning direction; and a controller to synchronize an ejection operation of the printhead and a feeding operation of the print medium-feeding unit such that ink ejected from the printhead is deposited at a desired position of the print medium, wherein the N nozzle units are disposed such that a distance along the subsidiary direction between centers of nozzles of the nozzle units that are adjacent to each other is about D×M+D/N from a nozzle unit disposed at a first end of the printhead to a nozzle unit disposed at a second end of the printhead, where M is a predetermined integer and D is a nozzle pitch.

8. The scanning type inkjet image forming apparatus of claim 7, wherein each of the N nozzle units is spaced apart from one another in the subsidiary scanning direction by a predetermined gap.

9. The scanning type inkjet image forming apparatus of claim 7, wherein each of the N nozzle units includes the same number of nozzles.

10. The scanning type inkjet image forming apparatus of claim 7, wherein the N nozzle units are disposed such that a distance along the main scanning direction between centers of the nozzles of the adjacent nozzle units is about d×L+d/N from the first end nozzle unit to the second end nozzle unit, where L is a predetermined integer and d is a diameter of a nozzle.

11. The scanning type inkjet image forming apparatus of claim 7, wherein the N nozzle units include a first nozzle unit and a second nozzle unit.

12. The scanning type inkjet image forming apparatus of claim 11, further comprising:

a printing environment information unit to store information about printing resolution when a printing operation is performed with a predetermined resolution, wherein the controller operates the first and second nozzle units according to the printing resolution stored in the printing environment information unit.

13. The scanning type inkjet image forming apparatus of claim 12, wherein the controller performs a first scanning operation including a printing operation using the first nozzle unit with an actual resolution and feeds the print medium by a width of the first nozzle unit before performing a second scanning operation including another printing operation using the first nozzle unit.

14. The scanning type inkjet image forming apparatus of claim 12, wherein the controller performs a first scanning operation including a printing operation using the first nozzle unit and the second nozzle unit with a higher resolution and feeds the print medium by a width of the first nozzle unit before performing a second scanning operation including another printing operation using the first nozzle unit and the second nozzle unit.

15. The scanning type inkjet image forming apparatus of claim 14, wherein the width of the first nozzle unit is the same as a width of the second nozzle unit.

* * * * *

UNITED STATES PATENT AND TRADEMARK OFFICE

CERTIFICATE OF CORRECTION

PATENT NO. : 7,637,590 B2
APPLICATION NO. : 11/437821
DATED : December 29, 2009
INVENTOR(S) : Jeong et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 842 days.

Signed and Sealed this

Ninth Day of November, 2010

David J. Kappos

David J. Kappos
*Director of the United States Patent and Trademark Office*